United States Patent [19]

Sasaya et al.

[11] 4,407,638

[45] Oct. 4, 1983

[54] SWASH PLATE TYPE COMPRESSOR WITH SILENCER STRUCTURE

[75] Inventors: Kazushi Sasaya, Katsuta; Takashi Degawa; Atsushi Suginuma, both of Mito; Noriharu Sato, Katsuta, all of Japan

[73] Assignee: Hitachi, Ltd., Tokyo, Japan

[21] Appl. No.: 229,063

[22] Filed: Jan. 28, 1981

[30] Foreign Application Priority Data

Jan. 28, 1980 [JP] Japan ..... 55-7846

[51] Int. Cl.[3] ..... F04B 3/02

[52] U.S. Cl. ..... 417/269; 417/312

[58] Field of Search ..... 417/313, 312, 269

[56] References Cited

U.S. PATENT DOCUMENTS

| | | | |
|---|---|---|---|
| 3,676,024 | 7/1972 | Akaiki | 417/269 |
| 3,785,751 | 1/1974 | Nemoto | 417/269 |
| 3,904,320 | 9/1975 | Kishi | 417/269 |
| 4,221,544 | 9/1980 | Ohta | 417/269 |
| 4,226,572 | 10/1980 | Nakayama | 417/269 |
| 4,283,997 | 8/1981 | Takahashi | 417/269 |

*Primary Examiner*—William L. Freeh

*Attorney, Agent, or Firm*—Antonelli, Terry & Wands

[57] ABSTRACT

A swash plate type compressor including a partition plate mounted in a side cover for axially partitioning the interior of the side cover into two portions. One of said two portions interposed between the partition plate and a valve plate functions as a high pressure chamber, and the other portion interposed between the partition wall and a bottom wall surface of the cover functions as a silencing chamber. A compressed refrigerant discharged from cylinder bores and introduced into the high pressure chamber is discharged from the high pressure chamber through the partition plate into the silencing chamber where pulsations of pressure are removed from the refrigerant.

By directing the compressed refrigerant discharged from the high pressure chamber toward the center of the silencing chamber and by drawing off the refrigerant from the center of the silencing chamber and introducing same into the refrigerant cycle, increased effects can be achieved in silencing noises.

14 Claims, 14 Drawing Figures

SWASH PLATE TYPE COMPRESSOR WITH SILENCER STRUCTURE

BACKGROUND OF THE INVENTION

1. Field of the Invention

This invention relates to swash plate type compressors used in the refrigeration cycle of air conditioning systems for motor vehicles, for example, and more particularly it is concerned with a silencer structure for the compressor of the type described which has the effect of removing within the compressor the pulsations of pressure of a refrigerant in a gaseous state under high pressure that is compressed by and discharged from the compressor.

2. Description of the Prior Art

A swash plate type compressor comprises a rotary shaft and a swash plate secured to the rotary shaft which moves in swinging movement as the rotary shaft rotates. The rotary shaft is journaled by a cylinder block and disposed coaxially with the center line of the cylinder block which is formed with a plurality of cylinder bores disposed parallel to the rotary shaft for receiving pistons for sliding movement therein.

The pistons are connected to the swash plate through a mechanism for converting the swinging movement of the swash plate into a reciprocatory movement of the pistons, so that rotation of the rotary shaft causes the pistons to move in reciprocatory movement in the cylinder bores. The cylinder block has a side cover mounted at one end portion thereof with a valve plate being interposed between the side plate and the cylinder block. A space enclosed by the side cover and valve plate is divided into a low pressure chamber and a high pressure chamber. The low pressure chamber and high pressure chambers are both maintained in communication with the cylinder bores via suction and discharge valves mounted on the front and rear surfaces of the valve plate.

As the pistons move within the cylinder bores in a direction in which they move away from the valve plate, the volume of the cylinder bores increases and the refrigerant is drawn into the cylinder bores from the low pressure chamber via the suction valves. Conversely, as the piston moves within the cylinder bores in a direction in which they move toward the valve plate, the volume of the cylinder bores decreases and the refrigerant is discharged through the discharge valves into the high pressure chamber while being compressed. The refrigerant compressed in the cylinder bores is successively discharged from the cylinder bores and introduced into the high pressure chamber, so that the pressure in the high pressure chamber increases each time the compressed refrigerant is introduced thereinto from each cylinder bore.

The refrigerant in a compressed state delivered by the compressor to the refrigeration cycle produces pulsations of pressure of the same number as the cylinder bores while the rotary shaft makes one complete revolution.

U.S. Pat. No. 3,712,759 (U.S. Ser. No. 103,412 of Jan. 4, 1971; Inventor, John W. Olson, Jr.) and U.S. Pat. No. 3,904,320 (U.S. Ser. No. 358,334 of May 8, 1973; Inventors, Kishi et al.) each disclose a swash plate type compressor. The compressor disclosed in the former is what is generally referred to as a single side swash plate type compressor in which seven bores are formed at one side of the swash plate, and the compressor disclosed in the latter is what is generally referred to as a double side swash plate type compressor in which three bores are formed at either side of the swash plate or six bores in total are formed at both sides of the swash plate.

In the former type compressor, seven pressure peaks are produced in a high pressure chamber in a side cover during one complete revolution of the swash plate. In the latter type compressor, the refrigerant compressed in the three bores at one side of the swash plate is directly discharged from the bores into a high pressure chamber formed in a side cover at the side from which the refrigerant is drawn off. The refrigerant compressed in the three bores at the other side of the swash plate is first discharged from the bores into a high pressure chamber formed in another side cover at the other side from which the refrigerant is led through a communication passage to the high pressure chamber formed in the side cover at the side from which the refrigerant is drawn off. Thus in the latter type compressor, six pressure peaks are produced in the high pressure chamber formed in the side cover at the side from which the refrigerant is drawn off while the swash plate makes one complete revolution.

The refrigerant compressed in the compressor of the swash plate type and supplied to the refrigerant cycle produces pulsations of pressure of a basic frequency of $n \times m$ wherein n is the number of revolutions of the swash plate and m is the number of the cylinder bores. When the refrigerant directly delivered to the refrigeration cycle has the aforesaid pulsations of pressure, the component parts of the refrigeration cycle, including a condenser, pipes and an evaporator, are caused to vibrate. This would produce noises or cause damage to welds formed in the component parts of the refrigeration cycle.

To avoid these disadvantages, a proposal has been made, first of all, to provide a silencer in a pipe connecting the compressor to the condenser as an independent member.

Secondly, in a compressor of the double side swash plate type, a proposal has been made, as disclosed in U.S. Pat. No. 3,577,891 (U.S. Ser. No. 851,687 of Aug. 20, 1969; inventor, Tani), to utilize as silencing chambers the spaces of the segmental cross-sectional shape formed between the bores of the cylinder blocks.

Thirdly, a proposal has been made, as disclosed in Japanese Utility Model Application Laid-Open Number 44313/75 (Application No. 97708/73; Application Date, Aug. 20, 1973; Inventor; Yamada et al.), to provide a silencing chamber at one side of the side cover for drawing off the compressed refrigerant through the silencing chamber.

Fourthly, a proposal has been made in U.S. Ser. No. 950,573 of Oct. 12, 1978 (inventor, Kishi), now U.S. Pat. No. 4,274,813, to partition the high pressure chamber within the side cover into over two chambers by partition plates arranged axially thereof.

Some disadvantages are associated with all the silencer structures of the prior art. The silencer structure of the first proposal requires an additional pipe for connecting the silencer to the compressor and condenser, and there is the risk of the refrigerant leaking through the connections. In the silencer structure of the second proposal, the diameter of the compressor becomes large, and special means should be provided for shielding from atmosphere a refrigerant passage formed at the outer periphery of the compressor. Additionally, a special silencing should be used because no satisfactory results are obtained in reducing noises in spite of the volume being large in this silencer structure. In the third proposal, a construction for sealing the silencing chamber to shield same from atmosphere should be provided. There is the risk of the refrigerant leaking through the sealing construction. In the silencer structure of the fourth proposal, difficulties have been encountered in providing the silencing chamber with a necessary volume, so that satisfactory silencing effects have been hard to achieve.

SUMMARY OF THE INVENTION

A first object of the present invention is to provide a swash plate type compressor capable of removing from the refrigerant, compressed and delivered from the compressor, pulsations of pressure of the basic frequency $n \times m$ wherein n is the number of revolutions of the swash plate and m is the number of the cylinder bores.

A second object is to provide a silencer structure of compact size that can be built in the compressor without increasing the volume thereof.

A third object is to provide a swash plate type compressor provided with a silencer structure capable of being built in the compressor without increasing the number of process steps required for assembling the compressor.

The aforesaid objects can be accomplished as follows. A side cover of a bowl shape has its inner space axially divided into two portions by a partition plate. A partition wall separating a low pressure chamber from a high pressure chamber is mounted between the partition plate and a valve plate so that the high pressure chamber is formed outside the low pressure chamber in a manner to enclose same.

A flat space is defined between the bottom of the side cover and the partition plate, and a refrigerant draw-off port is formed on the outer wall surface of the side cover facing a silencing chamber. What is important is that a compressed refrigerant outlet port is provided to enable the compressed refrigerant to be discharged from the high pressure chamber toward the center of the flat space, and that one end of the refrigerant draw-off port opens in the center of the flat space. By this arrangement, the flat space for allowing the refrigerant to be expanded extends radially between the refrigerant outlet port and the refrigerant draw-off port.

The present invention is based on the results of experiments which show that with the volumes of the silencing chambers being equal, a flat silencing chamber extending radially can achieve higher silencing effects than an axially elongated silencing chamber.

DESCRIPTION OF THE EMBODIMENTS

Figure 1:
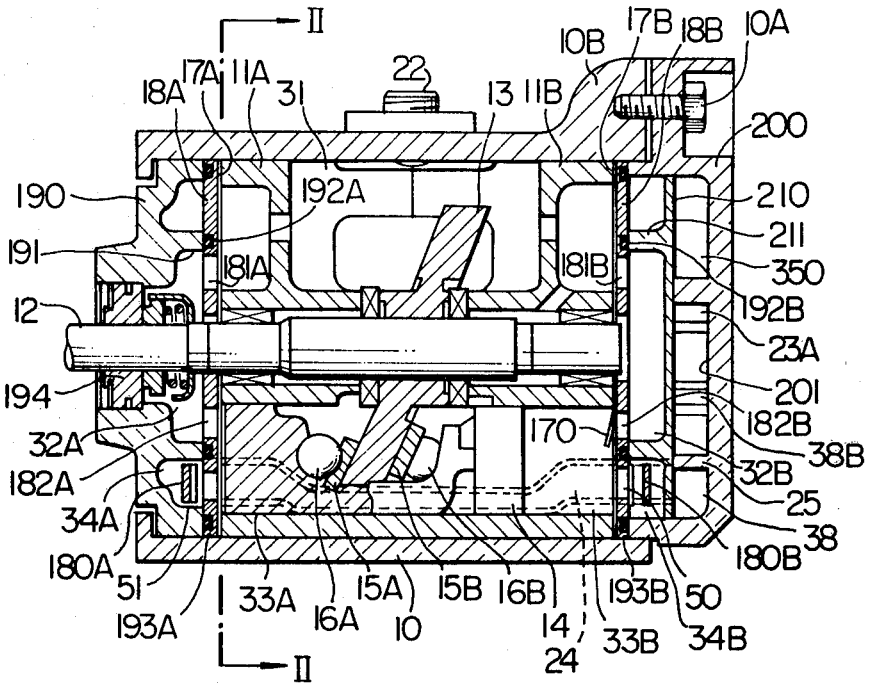
FIG. 1 is a vertical longitudinal sectional view, taken along the line I—I in FIG. 2, of the double side swash plate type compressor having the silencer structure according to the invention.

A shaft 12 is rotatably journaled in the center of left and right cylinder blocks 11A and 11B and has a swash plate 13 secured thereto. Double-head type pistons 14 are mounted through slippers 15A and 15B and balls 16A and 16B on opposite sides of the swash plate 13. The cylinder blocks 11A and 11B are formed with three bores 33A and three bores 33B respectively, the three bores 33A and 33B of the cylinder blocks 11A and 11B being disposed parallel to the shaft 12 and located on the respective circumferences centered at the center of rotation of the shaft 12 and spaced apart from one another a circumferential extent of 120 degrees. The cylinder bores 33A and 33B form three pairs of cylinder bores 33A and 33B. One of the double-head pistons 14 is fitted in each pair of cylinder bores 33A and 33B for sliding movement, so that as the swash plate 13 moves in rotary swinging movement the double-head pistons 14 move in reciprocatory movement in the respective pairs of cylinder bores 33A and 33B.

The cylinder blocks 11A and 11B are assembled together and mounted in a cylindrical shell 10. The cylinder blocks 11A and 11B mounted in the shell 10 have secured to ends thereof a front cover 190 and a rear cover 200 respectively, with inlet valve plates 17A and 17B formed with inlet valves 170 and outlet valve plates 18A and 18B mounting outlet valve assemblies 180A and 180B being interposed between the cylinder blocks 11A and 11B and the front cover 190 and rear cover 200 respectively.

Figure 5:
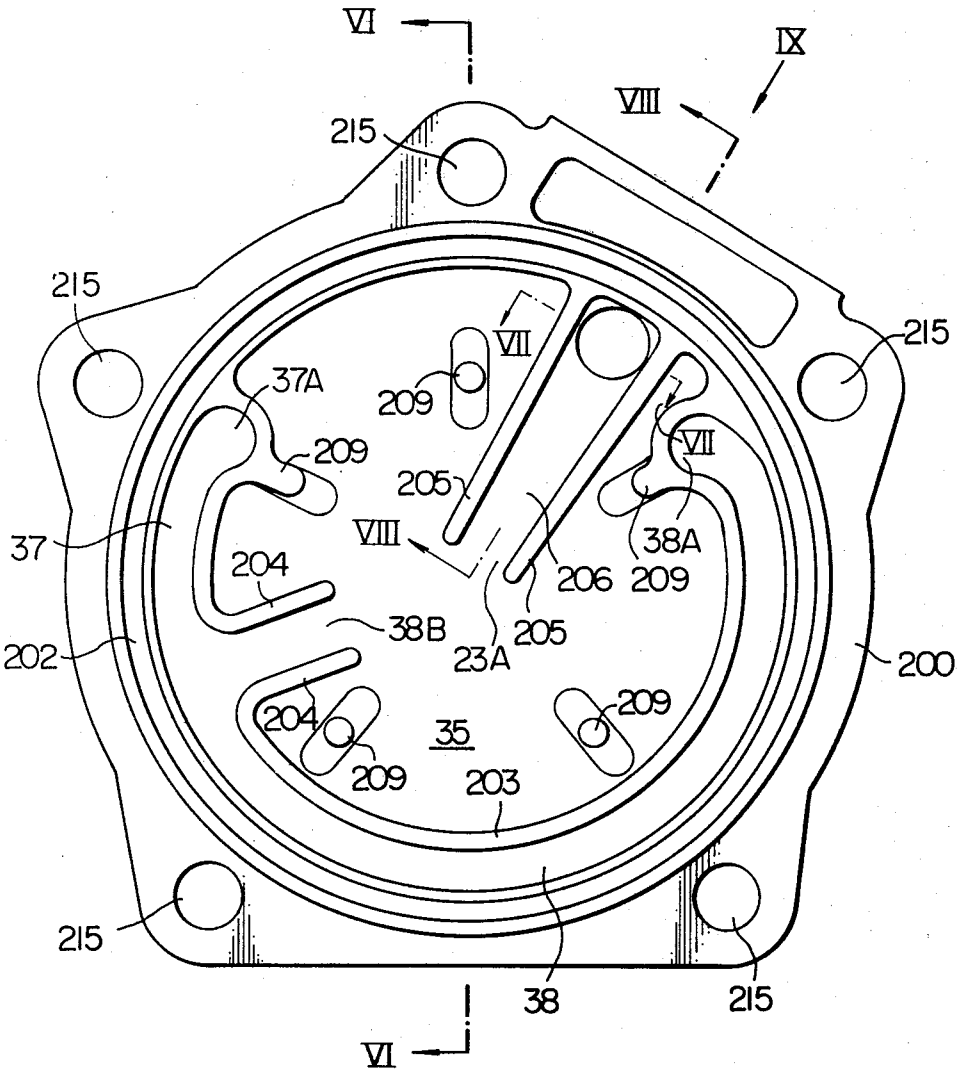
FIG. 5 is a plan view showing the interior of the side cover constituting the silencer structure according to the invention.
Figure 7:
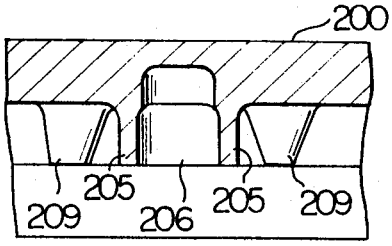
FIG. 7 is a sectional view taken along the line VII—VII in FIG. 5.

The rear cover 200 is secured to the shell 10 by threadably connecting same to a bulge 10B of the shell 10 by bolts 10A inserted in five openings 215 formed in an outer marginal portion of the rear cover 200 (for the openings 215, see FIG. 5, for example). The front cover 190 has formed integrally therewith an annular partition wall 191 for partitioning a space defined between the outlet valve plate 18A and front cover 190 into a low pressure chamber 32A and a high pressure chamber 34A. The low pressure chamber 32A and high pressure chamber 34A are sealed by a seal ring 192A. The high pressure chamber 34A is sealed by a seal ring 193A from atmosphere.

The shaft 12 extends through the low pressure chamber 32A and the front cover 190 to outside. A shaft seal assembly 194 is mounted in the low pressure chamber 32A for sealing the shaft 12 from the front cover 190. The low pressure chamber 32A communicates with a refrigerant inlet port 22 through an aperture 181A formed in the valve plates 17A and 18A and a swash plate chamber 31, and with the cylinder bores 33A through a suction aperture 182A formed in the valve plates 17A and 18A.

The high pressure chamber 34A which has the outlet valve assembly 180A mounted therein communicates with the cylinder bores 33A through a discharge aperture 51 formed in the valve plates 17A and 18A.

The rear cover 200 has its inner space partitioned by a partition plate 210 into two flat spaces. One flat space which is disposed at the side of the valve plate 18B is divided into a low pressure chamber 32B and a high pressure chamber 34B by an annular partition wall 211 formed integrally with the partition plate 210. The low pressure chamber 32B and high pressure chamber 34B are sealed by a seal ring 192B. The high pressure chamber 34B is sealed by a seal ring 193B from atmosphere. The low pressure chamber 32B communicates with the refrigerant inlet port 22 through an aperture 181B formed in the valve plates 17B and 18B and the swash plate chamber 31, and with the cylinder bores 33B through a suction aperture 182B and the inlet valve 170 formed in the valve plates 17B and 18B.

The high pressure chamber 34B which has the outlet valve assembly 180B mounted therein communicates with the cylinder bores 33B through the discharge aperture 51 formed in the valve plates 17B and 18B.

The other flat space on the side of a bottom wall surface 201 of the rear cover 200 serves as a silencing chamber 35. Formed around the silencing chamber 35 by an outer peripheral wall 202 of the rear cover and a peripheral wall 203 integral with the bottom wall surface 201 disposed inwardly of the outer peripheral wall 202 are high pressure refrigerant passages 37 and 38 closed at ends 37A and 38A thereof and joining each other at opposite ends into a passage 37B defined by a pair of partition walls 204 formed integrally with the peripheral wall 203 and extending toward the center of the silencing chamber 35.

Figure 8:
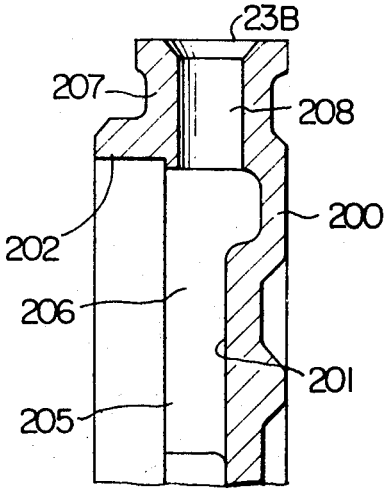
FIG. 8 is a sectional view taken along the line VIII—VIII in FIG. 5.
Figure 9:
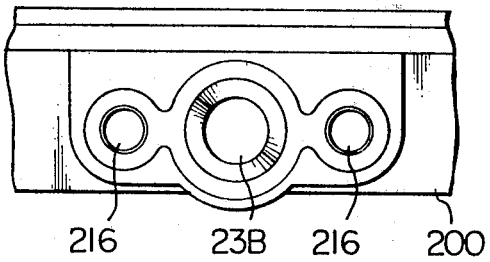
FIG. 9 is a view as seen in the direction of an arrow IX in FIG. 5.
Figure 10:
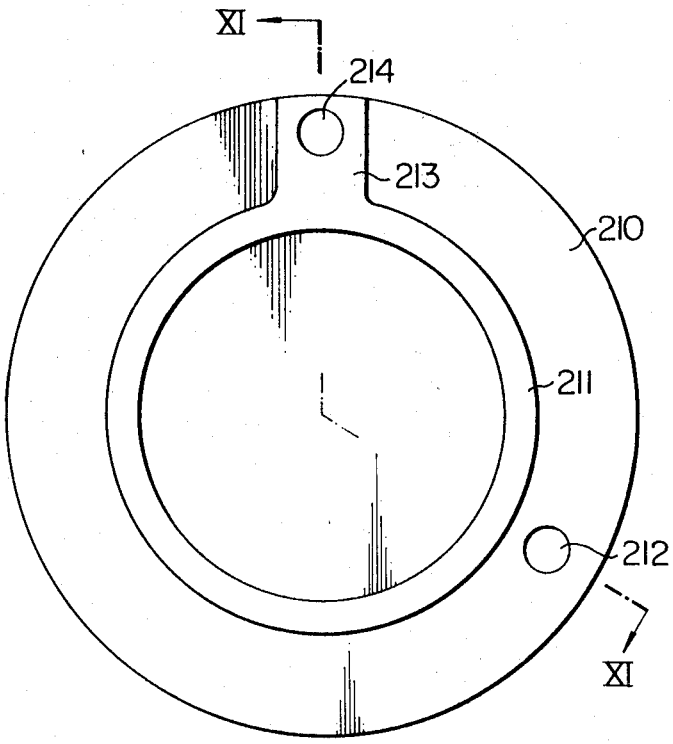
FIG. 10 is a plan view of the partition plate constituting the silencer structure according to the invention.
Figure 11:
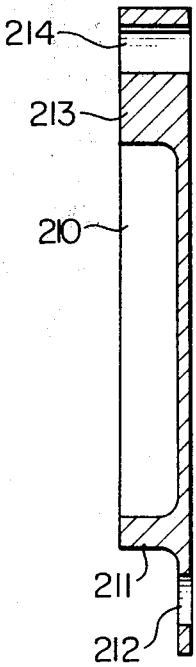
FIG. 11 is a sectional view taken along the line XI—XI in FIG. 10.

The bottom wall surface 201 of the rear end plate 200 is further formed thereon with a pair of partition walls 205 extending from the outer peripheral wall 202 to the center of the silencing chamber 35. The pair of partition walls 205 define therebetween a refrigerant draw-off passage 206 through which the refrigerant of high pressure is drawn off the silencing chamber 35 to outside. One end 23A of the refrigerant draw-off passage 205 opens in the center of the silencing chamber 35 and the other end 23B thereof opens in a base 207 for attaching a refrigerant draw-off metal member 23. The numeral 216 in FIG. 9 designates threaded openings for threadably connecting the metal member 23 to the compressor. The refrigerant draw-off passage 206 is connected to the other end 23B thereof through a tunnel 208 (see FIG. 8). The numeral 209 designates projections formed integrally with the bottom wall surface 201 of the rear end plate 200. The projections 209, peripheral wall 203 and partition walls 204 and 205 all have the same height and abut at their upper ends against the undersurface of the partition plate 210 to support the latter. As the partition plate 210 abuts at its undersurface against the peripheral wall 203 and partition walls 204 and 205 at the same time, the high pressure refrigerant passages 37 and 38, passage 37B and refrigerant draw-off passage 206 are all separated from the silencing chamber 35.

The partition plate 210 is formed in a position corresponding to that of the closed end 38A of the high pressure refrigerant passage 38 with a port 212 through which the closed end 38A of the high pressure refrigerant passage 38 communicates with the high pressure chamber 34B in the rear cover 200. The partition plate 210 is formed in a partition wall 211 with a bulge 213 in a position corresponding to that of the closed end 37A of the high pressure refrigerant passage 37, the bulge 213 projecting radially and formed therein with a bore 214 communicating with the closed end 37A of the high pressure refrigerant passage 37.

Figure 2:
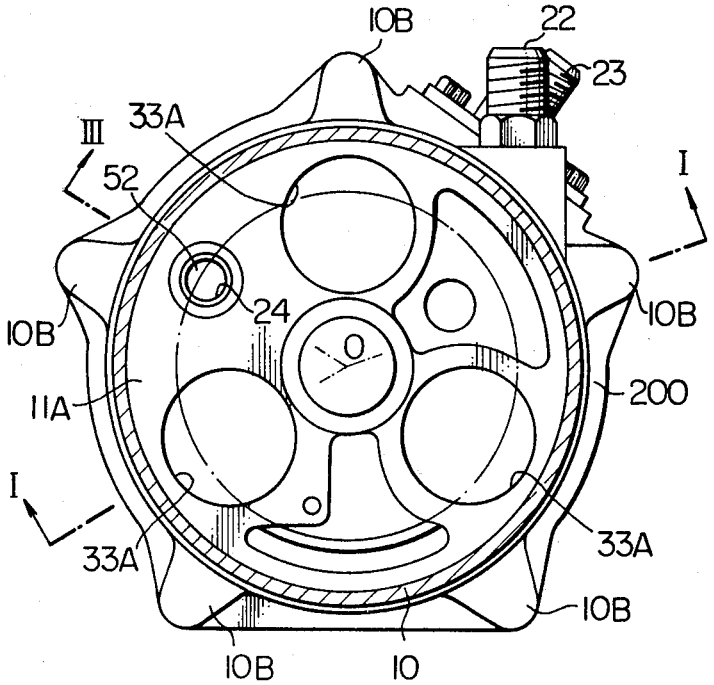
FIG. 2 is a sectional view taken along the line II—II in FIG. 1.
Figure 3:
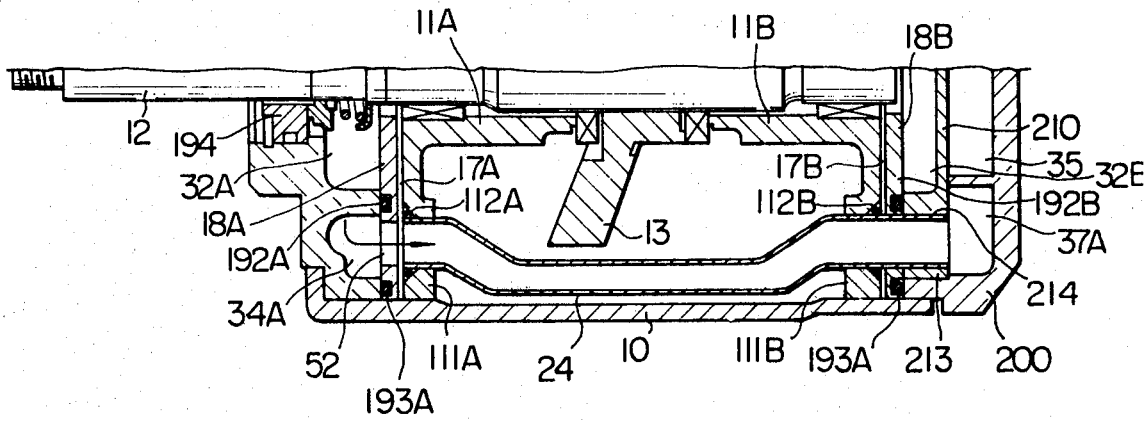
FIG. 3 is a sectional view taken along the line III—III in FIG. 2.
Figure 4:
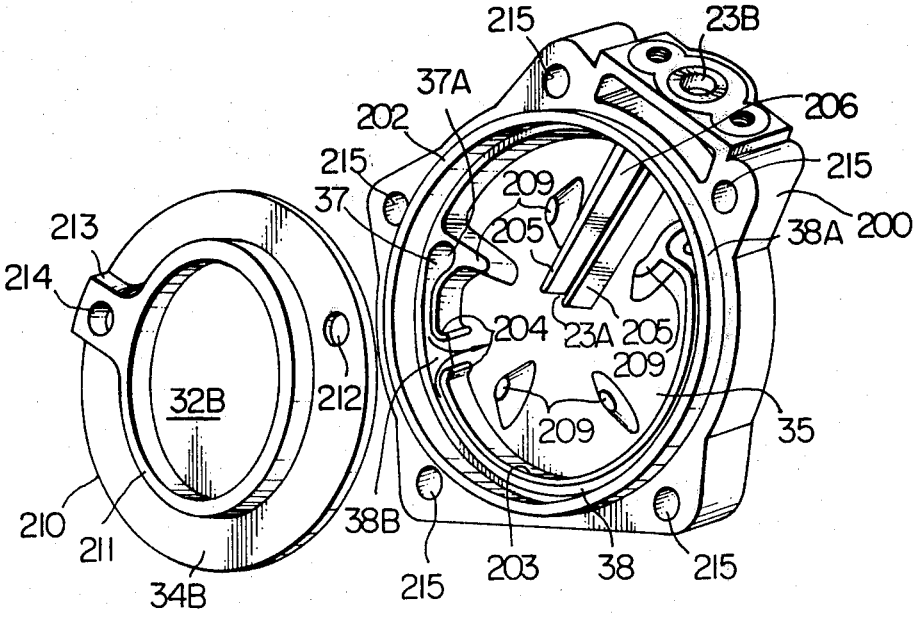
FIG. 4 is an exploded perspective view of the silencer structure according to the invention.
Figure 6:
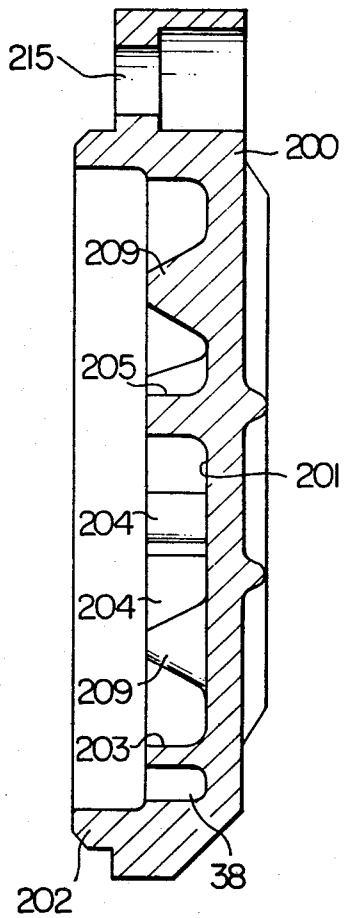
FIG. 6 is a sectional view taken along the line VI—VI in FIG. 5.

A high pressure pipe 24 connected at one end thereof to the high pressure chamber 34A in the front cover 190 is fitted at the other end thereof in the port 214 of the partition plate 210. As shown in FIGS. 2 and 3, the high pressure pipe 24 extends axially through a space of the segmental cross-sectional shape formed between the cylinder bores 33. The high pressure pipe 24 is force fitted at one end thereof in an end wall 111A of the cylinder block 11A and sealed against the swash plate chamber 31 by a seal ring 112A mounted at the outer periphery of the front end of the pipe 24 (see FIG. 3). The high pressure pipe 24 is maintained in communication with the high pressure chamber 34A via a port 52 formed in the valve plates 17A and 18A and force fitted at the other end thereof in an end wall 111B of the cylinder block 11B, extending through the end plate 111B, valve plates 17B and 18B and port 214 formed in the bulge 213 of the partition plate 210 to the closed end 37B of the high pressure refrigerant passage 37 formed in the rear cover 200. The high pressure pipe 24 is sealed against the swash plate chamber 31 by a seal ring 112B mounted between the pipe 24 and the end wall 111B of the cylinder block 11B. Thus the high pressure chamber 34A in the front conver 190 communicates with the closed end 37A of the high pressure refrigerant passage 37 in the rear cover 200.

A refrigerant of low pressure introduced through the inlet port 22 into the swash plate chamber 31 branches into two streams, one stream of refrigerant flowing leftwardly into the low pressure chamber 32A in the front cover 190 and the other stream flowing rightwardly into the low pressure chamber 32B in the rear cover 200. The refrigerant is drawn by suction from the low pressure chamber 32A into the cylinder bores 33A as the pistons 14 moving in sliding movement in the cylinder bores 33 shift in a direction away from the inlet valve plate 17A, and the refrigerant is drawn by suction from the low pressure chamber 32B into the cylinder bores 33B as the pistons 14 shift in a direction away from the inlet valve plate 17A. As the pistons 14 shift in a direction toward the inlet valve plate 17A, a compressed refrigerant is discharged from the cylinder bores 33A into the high pressure chamber 34A. As the pistons 14 shift in a direction toward the inlet valve plate 17B, a compressed refrigerant is discharged from the cylinder bores 33B into the high pressure chamber 34B. The compressed refrigerant is alternately discharged into the high pressure chambers 34A and 34B as the swash plate 13 rotates through 60 degrees. The compressed refrigerant introduced into the high pressure chamber 34A flows through the high pressure pipe 24 and high pressure refrigerant passage 37 into the passage 38B from which the refrigerant is directed toward the center of the silencing chamber 35. The compressed refrigerant introduced into the high pressure chamber 34B flows through the high pressure refrigerant passage 38 into the passage 38B from which the refrigerant is directed toward the center of the silencing chamber 35.

Thus three pressure peaks are produced in each one of the high pressure refrigerant passages 37 and 38 while the swash plate 13 makes one complete revolution. Since the pressure peaks are produced alternately, a total of six pressure peaks is produced in the passage 37B while the swash plate 13 makes one complete revolution.

When the refrigerant under high pressure is discharged from the passage 37B, the refrigerant is spread radially in the silencing chamber 35 before it reaches the one end 23A of the refrigerant draw-off passage 206. That is, the pressure of the refrigerant discharged from the passage 37B is reduced greatly as its pressure waves bounce from the peripheral wall 202 or 203 after striking it. Also, the bouncing pressure waves strike against each other and their energy is spent, so that the refrigerant has its pressure greatly reduced when it reaches the one end of the refrigerant draw-off passage 206. Thus pulsations of pressure can be wholly removed from the refrigerant of high pressure discharged from the refrigerant draw-off port 23 into the refrigeration cycle.

Figure 12:
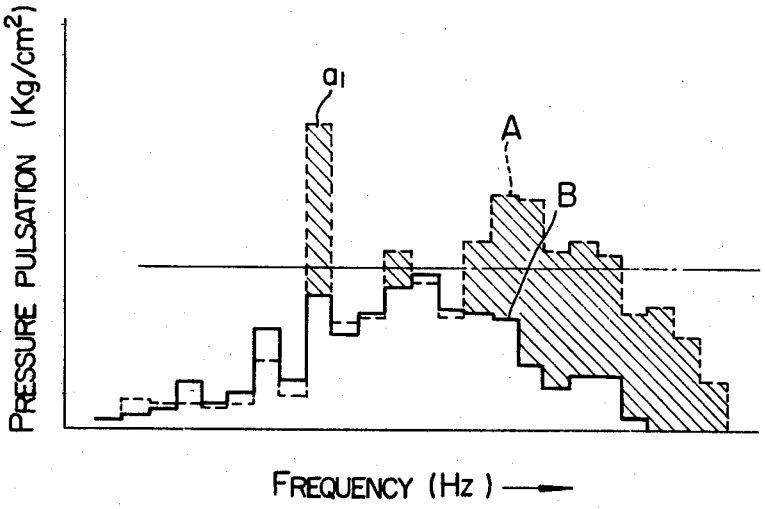
FIG. 12 is a graph showing the effects achieved by the present invention.

FIG. 12 shows the results achieved by the invention in reducing the noise of the high pressure refrigerant. In the figure, a region A shown in dotted lines represents the distribution of pulsations of pressure in a high pressure refrigerant discharged from the refrigerant draw-off port of a double side swash plate type compressor of the prior art, and a region B shown in solid lines represents the distribution of pulsations of pressure in a high pressure refrigerant discharged from the refrigerant draw-off port of the double side swash plate type compressor provided with the silencer structure according to the invention.

In FIG. 12, it will be seen that the present invention enables pulsations of pressure occurring in a high frequency region to be wholly removed. l represents the critical value of pulsations of pressure for the refrigeration cycle of the double side swash plate type compressors. The invention enables values of pulsations of pressure for all the frequency regions to be reduced below the critical value. The end can be attained without providing an independent silencer structure separately from the compressor and without increasing the volume of the compressor. A portion represented by $a_1$ is a low frequency pulsation component which is characteristic of a double side swash plate type compressor.

Heretofore, it has been customary to collect in a high pressure chamber on the rear side the compressed refrigerant discharged into a high pressure chamber at the front side and to deliver the collected refrigerant from the rear side high pressure chamber to a refrigerant draw-off port. The compressed refrigerant discharged into the front high pressure chamber is passed on to the rear high pressure chamber through an elongated high pressure pipe, so that there is a time lag of the cycle of pulsations occurring in the compressed refrigerant delivered from the front high pressure chamber to the rear high pressure chamber behind the cycle of pulsations of pressure occurring in the compressed refrigerant directly discharged into the rear high pressure chamber. The result of this is that the pressure pulsations of the refrigerant interfere with each other in the rear high pressure chamber, causing a pressure pulsation component to be produced which has a frequency one-half that of the basic frequency of the pressure peaks (or six pressure peaks for one complete revolution of the swash plate). It is impossible for a silencer to remove the pulsations of pressure of a frequency one-half that of the basic frequency because its peak pressure rises as high as twice that of the basic frequency.

In the invention, the high pressure refrigerant passage 38 from its closed end 38A to its end at which the passage 38 joins the high pressure refrigerant passage 37 is equal in length to the refrigerant passage extending from the front end of the high pressure pipe 24 through the refrigerant passage 37 to the end of the passage 37 at which it joins the passage 38. This eliminates the occurrence of a phase difference between the times at which the pressure pulsations of the high pressure refrigerant reach the passage 38B from the high pressure chamber 34A in the front cover 190 and from the high pressure chamber 34B in the rear cover 200. Thus the compressed refrigerant discharged from the passage 38B into the silencing chamber 35 produces six pressure peaks in an orderly manner while the swash plate makes one complete revolution. As a result, the pressure pulsation component of low frequency that has not been removed by a silencer of the prior art can be wholly removed as shown in solid lines in FIG. 12.

While the invention has been shown and described as being applied to a double side swash plate type compressor, it will be understood that the invention can also have application in a single side swash plate type compressor. Since a single side swash plate type compressor has only one high pressure chamber, the problem of the pressure pulsation component of low frequency is not raised. Thus the need to provide the silencing chamber 35 with complicated high pressure refrigerant passages of the type described hereinabove can be eliminated.

Figure 13:
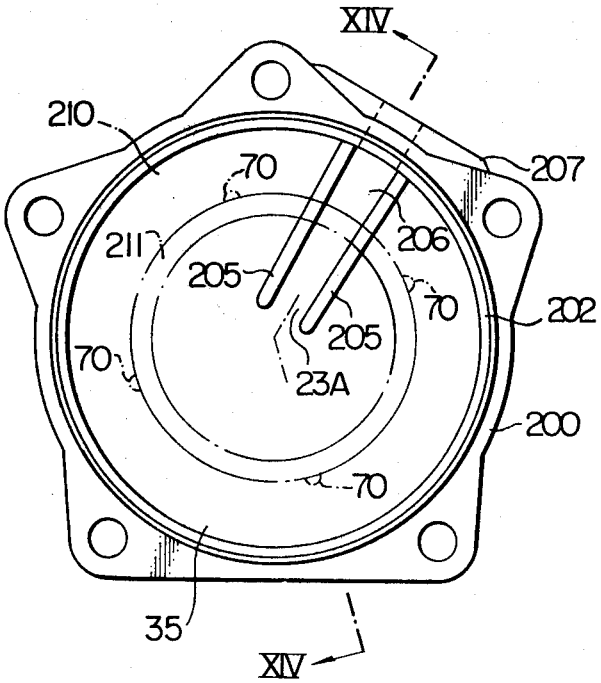
FIG. 13 is a view showing a modification of the silencing chamber and the partition plate.
Figure 14:
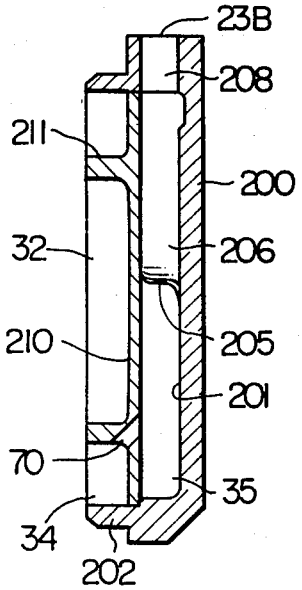
FIG. 14 is a sectional view taken along the line XIV—XIV in FIG. 13.

FIGS. 13 and 14 show the construction of the partition plate and silencing chamber suitable for use in a single side swash plate type compressor. As shown, the partition plate 210 includes an annular partition wall 211 formed at its base with four angling ducts 70 located equidistantly from one another. The angling ducts 70 maintain a high pressure chamber 34 defined between the partition plate 210 and a valve plate in communication with the sliencing chamber 35 of the flat shape disposed at the back of the partition plate 210.

Each of the angling ducts 70 extends from the high pressure chamber 34 to the silencing chamber 35 in such a manner that it is inclined at an angle of about 45 degrees with respect to the center axis of the partition plate 210, so that streams of compressed refrigerant discharged from the high pressure chamber 34 through the angling ducts 70 into the silencing chamber 35 are all directed toward the center of the silencing chamber 35. The cover 200 is formed at its bottom wall 201 with a pair of partition walls 205 extending from the outer peripheral wall 202 to the center of the silencing chamber 35, as is the case with the embodiment shown and described hereinabove. The pair of partition walls 205 define therebetween the refrigerant draw-off passage 206 formed at one end with a refrigerant inlet 23A and communicating at the other end through a tunnel 208 with an opening 23B formed in a base 207 for attaching a refrigerant draw-off metal member 23.

Streams of compressed refrigerant are discharged from the high pressure chamber 34 through the angling ducts 70 and introduced into the silencing chamber 35 where they are directed toward the center. During this process, the streams of compressed refrigerant have their energy cancel each other out. The rest of the pressure wave is spread radially toward the outer peripheral wall 202 to bounce back therefrom. Thus the compressed refrigerant from the angling ducts 70 has its pressure reduced and the pressure pulsations of the compressed refrigerant flowing into the refrigerant draw-off passage 206 can be eliminated.

In the embodiments shown and described hereinabove, the refrigerant draw-off passage 206 has been defined as radially extending from the center of the silencing chamber for delivering the refrigerant to the outlet port 23 after leading same radially. However, the invention is not limited to this form of refrigerant draw-off passage and any passage leading the refrigerant from the center of the silencing chamber 35 to the refrigerant outlet port 23 may be used in place of the refrigerant draw-off passage 206. For example, a duct formed in the center of the cover 200 may take the place of the refrigerant draw-off port 206, in which case the refrigerant outlet port 23 is secured to the center of the outer wall surface of the cover 200.

What is claimed is:

1. A swash plate type compressor provided with a silencer structure, comprising:

a rotary shaft;

a swash plate secured to said rotary shaft;

at least one cylinder block journalling said rotary shaft for rotation;

a plurality of pistons engaged by said swash plate and caused to move in reciprocatory movement in a direction parallel to said rotary shaft by the rotary swinging movement of said swash plate;

a plurality of cylinder bores formed in said cylinder block, each of said cylinder bores having fitted therein one of said pistons for sliding movement;

an end plate attached to an end of said cylinder block opposite said swash plate;

first partition wall means defining at one side of said plate a first flat space separated from atmosphere;

second partition wall means defining at one side of said first flat space a second flat space separated from atmosphere;

a high pressure chamber in said first flat space receiving a compressed refrigerant discharged from said cylinder bores and introduced thereinto through said plate;

passage means for directing the compressed refrigerant discharged from said high pressure chamber in a generally radial direction toward the center of said second flat space; and refrigerant draw-off passage means opening at one end in the center of said second flat space and communicating at the other end externally of said compressor.

2. A swash plate type compressor as claimed in claim 1, further comprising at least one cover of a bowl shape secured to an end of said cylinder block opposite said swash plate with said end plate disposed therebetween; a partition plate, of which said first and second wall means are comprised, being mounted in said cover for axially partitioning the interior of said cover into two portions; whereby said first flat space is defined between said partition plate and said end plate; and said second flat space is defined between said partition plate and a bottom wall surface of said cover.

3. A swash plate type compressor as claimed in claim 2, further comprising an annular partition wall located between said partition plate and said plate, a low pressure chamber formed inside said annular partition wall for receiving a refrigerant of low pressure therein, and an inlet port formed in said plate for communicating said low pressure chamber with said cylinder bores, and wherein said high pressure chamber is located outside said annular partition wall.

4. A swash plate type compressor provided with a silencer mechanism as claimed in claim 3, wherein said draw-off passage means comprises a pair of ribs in said second flat space extending radially outwardly from the center of said second flat space and a refrigerant draw-off passage communicating at one end with an outer end of a passage defined between said ribs and connected at the other end to the exterior of said compressor.

5. A swash plate type compressor provided with a silencer mechanism as claimed in claim 2, wherein said draw-off passage means comprises a pair of ribs in said second flat space extending radially outwardly from the center of said second flat space and a refrigerant draw-off passage communicating at one end with an outer end of a passage defined between said ribs and connected at the other end to the exterior of said compressor.

6. A swash plate type compressor as claimed in claim 2, wherein said at least one cylinder block comprises a front cylinder block and a rear cylinder block located on opposite sides of said swash plate, wherein said cylinder bores comprise a plurality of cylinder bores formed in said front cylinder block and a plurality of cylinder bores formed in said rear cylinder block, one of said cylinder bores formed in said front cylinder block being disposed coaxially with one of said cylinder bores formed in said rear cylinder block on opposite sides of said swash plate to form a pair so that a plurality of parts of cylinder bores are formed, wherein said plurality of pistons are double-head pistons each fitted in one of said pairs of cylinder bores for sliding movement, wherein said at least one cover comprises a front cover and a rear cover, said front cover being secured to said front cylinder block at an end thereof opposite said swash plate with a front end plate being interposed therebetween and said rear cover being secured to said rear cylinder block at an end thereof opposite said swash plate with a rear end plate being interposed therebetween, wherein said at least one high pressure chamber comprises a first high pressure chamber in said front cover for receiving a compressed refrigerant discharged from the cylinder bores in said front cylinder block and a second high pressure chamber in said rear cover for receiving a compressed refrigerant discharged from the cylinder bores in said rear cylinder block, and wherein said passage means is adapted to receive the compressed refrigerant introduced into said first high pressure chamber and the compressed refrigerant introduced into said second high pressure chamber and join them to each other so that all the compressed refrigerant can be directed in a generally radial direction toward the center of said second flat space.

7. A swash plate type compressor provided with a silencer mechanism as claimed in claim 6, wherein said draw-off passage means comprises a pair of ribs in said second flat space extending radially outwardly from the center of said second flat space and a refrigerant draw-off passage communicating at one end with an outer end of a passage defined between said ribs and connected at the other end to the exterior of said compressor.

8. A swash plate type compressor as claimed in claim 6, further comprising a high pressure pipe connected at one end to said first high pressure chamber and at the other end to one end of a high pressure refrigerant passage formed along an inner periphery of said second flat space, and a port formed in said partition plate for communicating said second high pressure chamber with one end of a second high pressure refrigerant passage formed along an inner periphery of said second flat space, and wherein said passage means extends from the junction of said first high pressure refrigerant passage and said second high pressure refrigerant passage in a generally radial direction toward the center of said second flat space.

9. A swash plate type compressor provided with a silencer mechanism as claimed in claim 8, wherein said draw-off passage means comprises a pair of ribs in said second flat space extending radially outwardly from the center of said second flat space and a refrigerant draw-off passage communicating at one end with an outer end of a passage defined between said ribs and connected at the other end to the exterior of said compressor.

10. A swash plate type compressor as claimed in claim 8, characterized in that the length of said high pressure tube from said one end connected to said first high pressure chamber to the junction of said first high pressure refrigerant passage and said second high pressure refrigerant passage and said second high pressure refrigerant passage is substantially equal to the length of said second high pressure refrigerant passage from the end thereof to the junction of said second high pressure refrigerant passage and said first high pressure refrigerant passage.

11. A swash plate type compressor provided with a silencer mechanism as claimed in claim 10, wherein said draw-off passage means comprises a pair of ribs in said second flat space extending radially outwardly from the center of said second flat space and a refrigerant draw-off passage communicating at one end with an outer end of a passage defined between said ribs and connected at the other end to the exterior of said compressor.

12. A swash plate type compressor provided with a silencer structure, comprising:

a rotary shaft;

a swash plate secured to said rotary shaft;

at least one cylinder block journalling said rotary shaft for rotation;

a plurality of pistons engaged by said swash plate and caused to move in reciprocatory movement in a direction parallel to said rotary shaft by the rotary swinging movement of said swash plate;

a plurality of cylinder bores formed in said cylinder block, each of said cylinder bores having fitted therein one of said pistons for sliding movement;

at least one cover of a bowl shape secured to an end of said cylinder block opposite said swash plate with a plate disposed therebetween;

a partition plate mounted within said cover for axially partitioning the interior of said cover into two portions;

at least one high pressure chamber defined between said partition plates and said plate for receiving a compressed refrigerant discharged from said cylinder bores through said plate;

a silencing chamber defined between said partition plate and a bottom wall surface of said cover for absorbing pulsations of pressure of the compressed refrigerant discharged from said high pressure chamber; and passage means for leading the compressed refrigerant from said silencing chamber to the exterior of said compressor.

13. A swash plate type compressor provided with a silencer structure as claimed in claim 12, wherein an annular partition wall is located between said partition plate and said plate so that the low pressure chamber is located inside said partition wall and the high pressure chamber is located outside said partition wall; and wherein a passage is formed in said partition plate communicating said high pressure chamber with the silencing chamber.

14. A swash plate type compressor provided with a silencer structure as claimed in claim 13, wherein a member for regulating the axial thickness of said silencing chamber is located between said partition plate and an inner bottom wall surface of said cover of the bowl shape, whereby said partition plate is held between said plate and the bottom wall surface of the side cover through said axial thickness regulating member and said partition wall.

* * * * *